US005570604A

United States Patent [19]

Fisch

[11] Patent Number: 5,570,604

[45] Date of Patent: Nov. 5, 1996

[54] DIE TRANSFER SYSTEM WITH INDEXING CONVEYOR SUPPORTED ON A WHEELED CART

[75] Inventor: Alfred C. Fisch, Clarkston, Mich.

[73] Assignee: Rapindex Incorporated, Bloomfield Hills, Mich.

[21] Appl. No.: 368,434

[22] Filed: Jan. 3, 1995

[51] Int. Cl.[6] ..... B21D 43/05

[52] U.S. Cl. ..... 72/405.02; 72/405.12

[58] Field of Search ..... 483/28, 29; 72/405.02, 72/405.05, 405.13, 405.11, 405.09, 405.06, 421, 405.12, 446, 448, 405.1; 198/621.1, 312, 317, 861.6, 861.1; 414/751

[56] References Cited

U.S. PATENT DOCUMENTS

| | | | |
|---|---|---|---|
| 4,186,589 | 2/1980 | Criblez | 72/421 |
| 4,449,390 | 5/1984 | Pontini | 72/405 |
| 4,635,465 | 1/1987 | Ashelman et al. | 72/448 |
| 5,035,134 | 7/1991 | Fisch | 72/405 |
| 5,129,254 | 7/1992 | Keizer et al. | 72/448 |
| 5,131,256 | 7/1992 | Sofy | 72/405 |
| 5,136,874 | 8/1992 | Fisch | 72/405 |
| 5,140,839 | 8/1992 | Bruns | 72/405.1 |
| 5,390,525 | 2/1995 | Fisch | 72/405.02 |

FOREIGN PATENT DOCUMENTS

| | | | |
|---|---|---|---|
| 157728 | 6/1989 | Japan | 72/446 |
| 192834 | 7/1990 | Japan | 72/405 |

*Primary Examiner*—William R. Briggs

*Attorney, Agent, or Firm*—Barnes, Kisselle, Raisch, Choate, Whittemore & Hulbert

[57] ABSTRACT

A die transfer system that includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a conveyor disposed on at least one lateral side of the lower die having hands for engaging successive workpieces and indexing the workpieces longitudinally of the lower die between the die stations. The conveyor is mounted on a wheeled cart carried by a support base, such as a bolster or the plant floor. The wheeled cart is selectively releasably fastened to the support base in such a way that the cart, and the conveyor carried by the cart, may be moved away from the lower die for operator access to the conveyor, and the upper and lower dies.

8 Claims, 3 Drawing Sheets

DIE TRANSFER SYSTEM WITH INDEXING CONVEYOR SUPPORTED ON A WHEELED CART

The present application is directed to a die transfer system, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of workpieces through the die stations, they possess the disadvantage that the workpieces must be formed in a linear array at spaced locations along the strip stock, leading to substantial inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are preseparated and fed to individual units of the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and re-engagement with the workpieces at each of the individual die stations.

U.S. Pat. No. 5,136,874, assigned to the assignee hereof, discloses a die transfer system that includes a lower die, an upper die carried for reciprocal vertical movement toward and away from the lower die to perform at least one operation on a workpiece positioned therebetween, and a conveyor arrangement for sequentially conveying workpieces between the dies. The conveyor arrangement has a pair of conveyors disposed on opposite lateral sides of the lower die. Each conveyor includes a plurality of hands for gripping workpieces, with the hands being spaced from each other lengthwise of the conveyor by distances corresponding to stations of the die. Each conveyor and its associated hands are indexed in a longitudinal direction through the die between stations in synchronism with motion of the upper die. The hands are moved simultaneously in at least one direction perpendicular to the longitudinal indexing direction by a camshaft that extends through the stations along an axis parallel to the indexing direction. A cam is mounted on each camshaft for rotation with the camshaft in synchronism with motion of the upper die. A follower arrangement couples each cam to the hands of the associated conveyor, so that reciprocal rotation of the camshaft about its axis results in reciprocal motion of the hands in one or more directions lateral to the longitudinal direction of conveyance of workpieces through the die stations. The conveyor camshafts are rotated by cam-and-follower arrangements coupled to the upper die, or by electric servo motors controlled by a master controller.

Although the die transfer system and indexing conveyor arrangement disclosed in the noted patent address and overcome problems and deficiencies theretofore extant in the art, further improvements remain desirable. For example, it is occasionally desirable to afford operator access to the workpiece hands of the conveyor and/or to the forming elements of the die either for purposes of maintenance, or for purposes of change-over to workpieces of different configuration. A general object of the present invention, therefore, is to provide a die transfer system of the character described above that features an improved conveyor arrangement with facility for providing operator access to the conveyor and/or die for maintenance, repair and/or change-over purposes and the like. Another and more specific object of the present invention is to provide a die transfer system of the described character that is economical in construction.

SUMMARY OF THE INVENTION

A die transfer system in accordance with the present invention includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a conveyor disposed on at least one lateral side of the lower die having hands for engaging successive workpieces and indexing the workpieces longitudinally of the lower die between the die stations. The conveyor is mounted on a wheeled cart carried by a support base, such as a bolster or the plant floor. The wheeled cart is selectively releasably fastened to the support base in such a way that the cart, and the conveyor carried by the cart, may be moved away from the lower die for operator access to the conveyor, and the upper and lower dies.

The wheeled cart in the preferred embodiment of the invention comprises an elongated rectangular frame that supports the conveyor. Casters are carried at each corner of the frame for sturdily supporting the frame and the conveyor during motion of the cart along the support base. A safety arm is pivotally carried by the frame. Casters are fastened to opposed ends of the safety arm, and the arm is pivoted to the frame midway between the opposed ends. The arm may be pivoted to a position extending laterally outwardly from each side of the cart frame to support the cart and conveyor against tipping when unfastened from the support base. The cart frame in the preferred embodiment of the invention is selectively releasably fastened to the support base by removable pivot pins at each longitudinal end of the cart frame. In this way, each pivot pin may be removed independently of the other, and the cart and conveyor may be pivoted on the support base away from the lower die about the axis of the other pivot pin. Alternatively, both pivot pins may be removed, and the cart and conveyor may be wheeled away from the dies.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
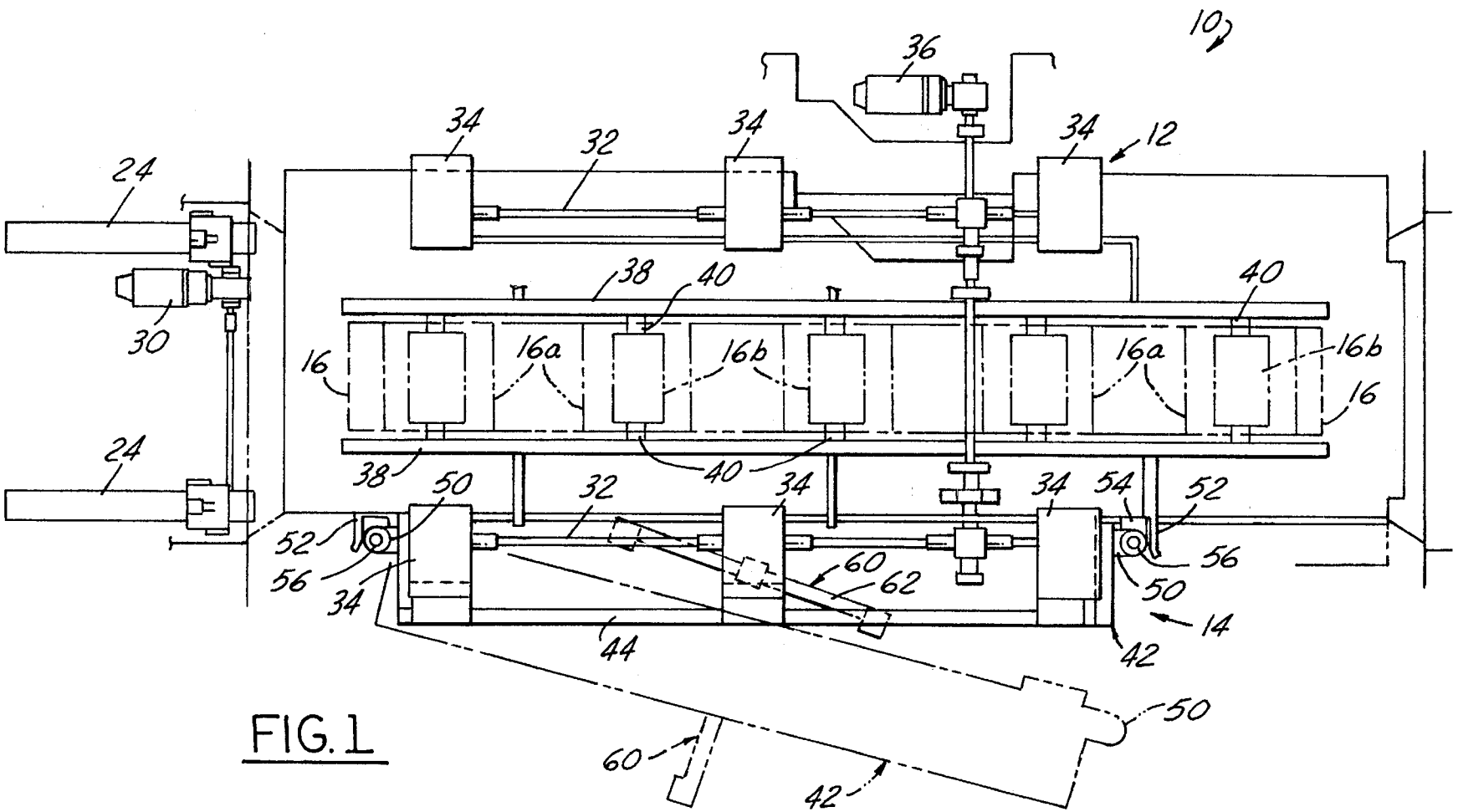
FIG. 1 is a schematic plan view of a die transfer system with conveyor in accordance with a presently preferred embodiment of the invention.
Figure 2:
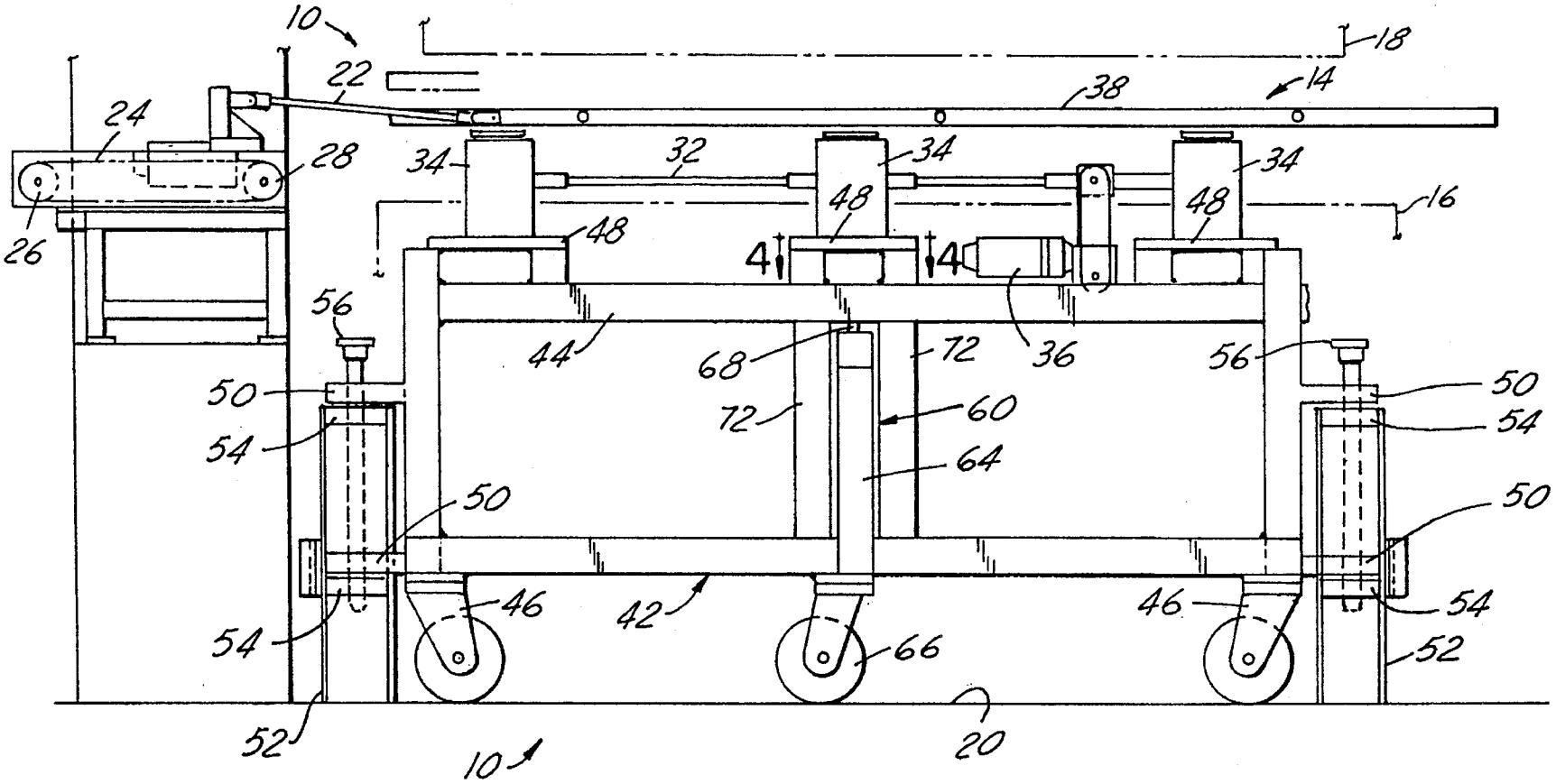
FIG. 2 is an elevational view of the transfer system illustrated in FIG. 1.

FIGS. 1–2 illustrate a die transfer system 10 in accordance with a presently preferred embodiment of the invention for indexing workpieces through successive stations of a workpiece die. A pair of workpiece conveyors 12,14 are positioned on laterally opposed sides of a lower die 16, and an upper die 18 is carried by a press support base 20 for vertical reciprocation with respect to lower die 16. In general, conveyors 12,14 cooperate with the upper and lower dies to define a workpiece load station at the upstream end of the conveyors, and unload station at the downstream end of the conveyors, and one or more stations **16*a* (FIG. 1) positioned therebetween at which desired operations are performed on each workpiece 16*b*** upon the descent of the upper die. Details of the dies, the geometry of the workpiece and operations performed thereon by the dies, are not directly germane to the present invention.

In general, the constructions of conveyors 12,14 are mirror images of each other. (For some workpieces, only one conveyor 14 is required.) Each conveyor 12,14 is coupled by a link 22 (FIG. 2) to associated endless loop conveyor belts 24 each trained over a pair of pulleys 26,28 spaced from each other in the longitudinal direction of workpiece conveyance. Belts 24 are driven in unison by an electric servomotor 30, which in turn is controlled by a motor controller. Each conveyor 12,14 has a longitudinally extending camshaft 32, which interconnects cam drive mechanisms disposed in longitudinally spaced cam housings 34. Camshafts 32 of both conveyors 12,14 are driven in unison by an electric servomotor 36, which in turn is controlled by the same motor controller as drives motor 30. The cams within housings 34 are coupled to a transfer bar 38 that extends longitudinally of lower die 16. One or more workpiece hands 40 are carried by transfer bars 38 for grasping workpieces **16*b* and indexing the workpieces between successive stations 16*a*. In general, hands 40 are indexed longitudinally of the conveyor and lower die by operation of servomotor 30, and are moved laterally inwardly and outwardly with respect to the lower die and the opposing conveyor, and upwardly and downwardly with respect to the lower die, by operation of transfer bar 38 and the cams within enclosures 34. To the extent thus far described, each conveyor 12,14** is the same as disclosed in above-noted U.S. Pat. No. 5,136,847, the disclosure of which is incorporated herein by reference for additional details of construction and operation of the conveyors.

In accordance with the present invention, a wheeled cart 42 supports at least conveyor 14 with respect to support base 20, which may comprise a die bolster or a plant floor. (Conveyor 12 may also be supported by an associated cart 42.) Cart 42 comprises a generally rectangular frame 44 of welded rectangular tube stock. A caster 46 is affixed adjacent to each lower corner of frame 44 for movably supporting the frame with respect to support base 20. A series of platforms 48 are carried along the top surface of frame 44 for supporting associated cam enclosures 34. Thus, in FIGS. 1 and 2, the entire conveyor 14, including cam enclosures 34, camshaft 32, transfer bar 38 and associated workpiece hands, is carried by wheeled cart 42 for movement along support base 20.

Figure 3:
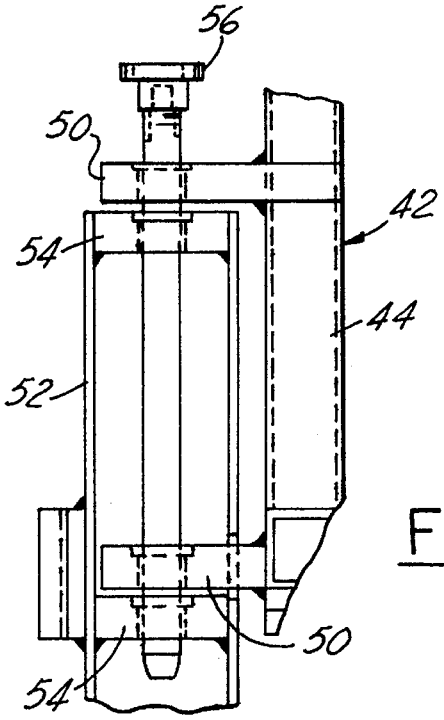
FIG. 3 is a fragmentary elevational view on an enlarged scale of the cart pivot pin construction illustrated in FIGS. 1 and 2.

A pair of spaced parallel vertically aligned tabs 50 extend longitudinally from each end of cart frame 44. A pair of stanchions 52 are affixed to support base 20 adjacent to each end of cart 42 when cart 42 is in its operative position adjacent to lower die 16. Each stanchion 52 supports a pair of aligned bearings 54, which are respectively disposed adjacent to tabs 50 on cart 42 in the operative position illustrated in FIGS. 2 and 3. A pivot pin 56 is removably received in axially aligned openings in tabs 50 and bearings 54. Thus, the two pivot pins 56 at the longitudinally spaced ends of cart 42 are removable from associated support stanchions 52 independently of each other. With the right-hand pin 56 removed, cart 42 and conveyor 14 supported thereby, are pivotal about the left-hand pivot pin 56 as illustrated in phantom in FIG. 1, being supported by casters 46 on support base 20, for access to the conveyor and the lower die. With both pins 56 removed, cart 42 and conveyor 14 supported thereby may be moved entirely away from the lower die.

Figure 4:
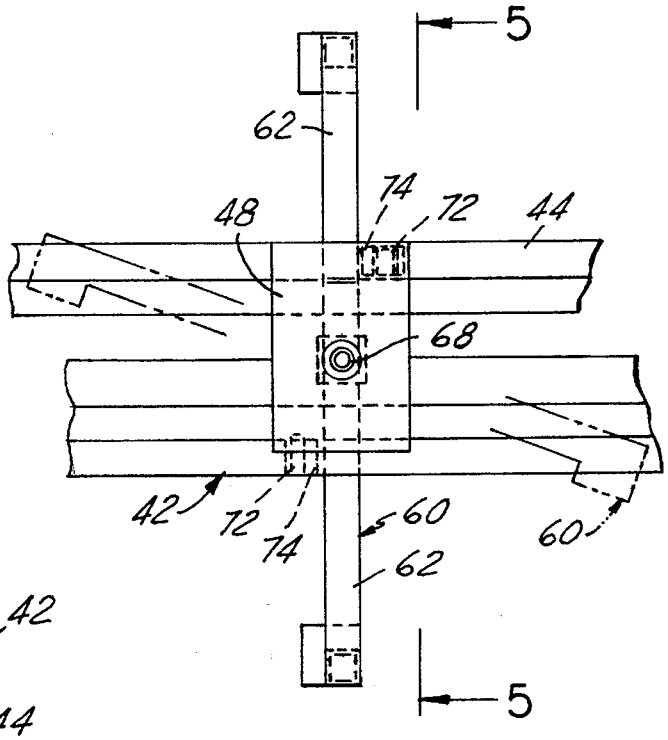
FIG. 4 is a fragmentary sectional view taken substantially along the line 4—4 in FIG. 2.
Figure 5:
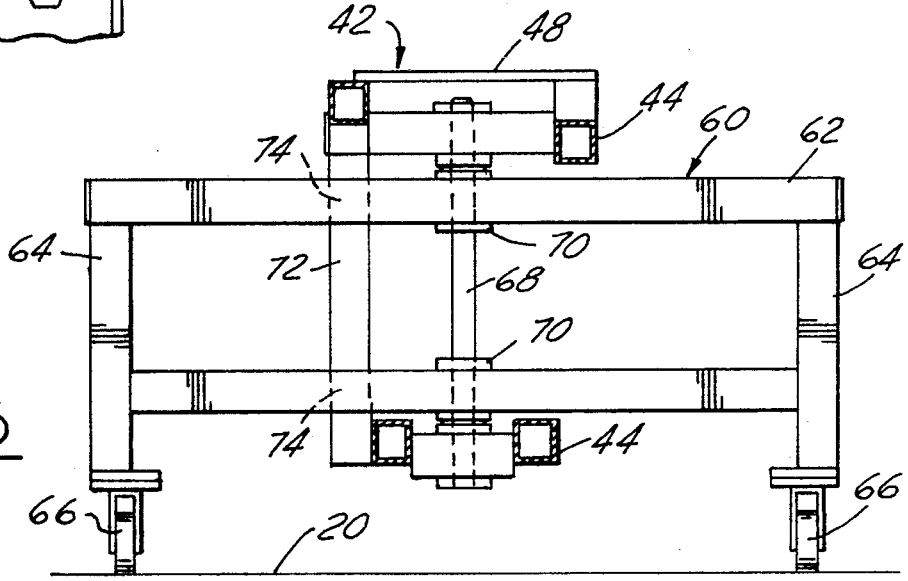
FIG. 5 is a view taken substantially along the line 5—5 in FIG. 4.

A safety arm 60 is pivotally carried by frame 44 of cart 42 midway between the longitudinally spaced ends of the cart. Safety arm 60 comprises a rectangular weldment 62 of tube stock having spaced ends 64 supported on base 20 by respective casters 66. A vertical shaft 68 is mounted within cart frame 44. The upper and lower reaches of arm weldment 62 are pivotally mounted to shaft 68 by respective sleeve bearings 70. Cart frame 44 is so constructed that arm 60 may be pivoted between a support position illustrated in FIG. 5, and in solid lines in FIGS. 2 and 4 and in phantom in FIG. 1, in which arm 60 laterally supports cart 42 and conveyor 14 to help prevent tipping about the longitudinal dimension of the cart, and a standby position illustrated in solid lines in FIG. 1 and phantom lines in FIG. 4, in which the support arm is nested within frame 44 generally longitudinally of the frame so as not to obstruct normal operation of conveyor 14. Diagonally opposed vertical legs 72 (FIGS. 4 and 5) on cart frame 44 have pads 74 (FIG. 4) that define abutment stops for safety leg 60 in the laterally outwardly extending position of the latter.

I claim:

1. A die transfer system that includes lower die means, upper die means carried for reciprocal movement toward and away from said lower die means to perform at least one operation on a workpiece positioned therebetween, and means for sequentially conveying workpieces between said die means comprising:

a support base, a conveyor disposed along one lateral side of said lower die means, said conveyor including means for engaging successive workpieces and indexing the workpieces in a longitudinal direction between said upper and lower die means, a wheeled cart supporting said conveyor on said support base, and means for selectively releasably fastening said cart to said support base for operation to convey workpieces between said die means and unfastening said cart from said support means such that said cart and conveyor may be moved away from said lower die means for operator access to said lower die means and said conveyor.

2. The system set forth in claim 1 wherein said wheeled cart comprises an elongated frame supporting said conveyor and wheel means at each end of said frame.

3. The system set forth in claim 2 wherein said cart further comprises an arm extending laterally from said frame and wheel means on an end of said arm remote from said frame for engaging said support base to prevent tipping of said frame laterally of the longitudinal dimension of said frame.

4. The system set forth in claim 3 wherein said cart further includes means mounting said arm to said frame for pivoting between a first position lateral to said frame to support said frame against tipping when said cart is unfastened from said support base and a second position longitudinal to said frame for unobstructed operation of said conveyor means.

5. The system set forth in claim 4 wherein said arm comprises an elongated member that extends laterally from both sides of said cart in said first position of said arm, said arm having spaced ends with said wheel means at said spaced ends and being pivotally mounted to said frame between said spaced ends.

6. The system set forth in claim 2 wherein said means for selectively releasably fastening said cart to said support base comprises first and second means at respective ends of said cart for selectively releasably fastening said cart to said support base.

7. The system set forth in claim 6 wherein said first and second means comprise respective pivot means pivotally fastening said cart to said support base, such that release of one of said first and second means enables wheeled pivoting motion of said cart on said support base about the other of said first and second means.

8. The system set forth in claim 6 wherein said conveying means further comprises a second said conveyor disposed along the other lateral side of said lower die means, said conveyors including means for engaging successive workpieces in unison and indexing the workpieces in unison between said die means.

* * * * *